US005458498A

United States Patent [19]

Ii et al.

[11] Patent Number: 5,458,498

[45] Date of Patent: Oct. 17, 1995

[54] ELECTRICAL CONNECTOR FOR CONNECTING FLEXIBLE PRINTED CIRCUIT BOARD

[75] Inventors: Hidehiro Ii, Yokohama; Shuji Kajinuma, Yamato; Shinichi Tadokoro, Fujisawa, all of Japan

[73] Assignee: Molex Incorporated, Lisle, Ill.

[21] Appl. No.: 150,522

[22] Filed: Nov. 10, 1993

[30] Foreign Application Priority Data

Dec. 25, 1992 [JP] Japan ..... 4-093152

[51] Int. Cl.[6] ..... H01R 23/72

[52] U.S. Cl. ..... 439/72; 439/70; 439/71

[58] Field of Search ..... 439/70, 71, 72, 439/73, 633

[56] References Cited

U.S. PATENT DOCUMENTS

| | | | |
|---|---|---|---|
| 3,701,071 | 10/1972 | Landman | 439/71 |
| 3,723,943 | 3/1973 | Hotze | 439/72 |
| 4,037,270 | 7/1977 | Ahmann | 439/71 |
| 4,222,622 | 9/1980 | Griffin | 439/71 |
| 4,235,500 | 11/1980 | Belopavlovich et al. | 339/176 |
| 4,349,238 | 9/1982 | Showman | 439/70 |
| 4,358,172 | 11/1982 | Narozny | 339/17 |
| 4,477,137 | 10/1984 | Ayer | 339/59 |
| 4,630,874 | 12/1986 | Renn et al. | 339/17 |
| 4,639,063 | 1/1987 | Mueller | 339/75 |
| 4,934,947 | 6/1990 | Brummans et al. | 439/77 |
| 4,936,792 | 6/1990 | Onoue et al. | 439/329 |
| 4,944,690 | 7/1990 | Imai | 439/492 |
| 5,061,205 | 10/1991 | Toramoto | 439/493 |
| 5,273,441 | 12/1993 | Volz | 439/72 |
| 5,288,236 | 2/1994 | McIntyre | 439/72 |
| 5,292,266 | 3/1994 | Matsuoka | 439/70 |
| 5,348,483 | 9/1994 | Sagno | 439/72 |

FOREIGN PATENT DOCUMENTS 3163771 7/1991 Japan .

*Primary Examiner*—Kurt Rowan

*Attorney, Agent, or Firm*—Stephen Z. Weiss

[57] ABSTRACT

An electrical connector arrangement for connecting the exposed conductors of a mating end of a printed circuit member in which an interior mating area for the printed circuit member is defined between left and right side walls of a housing. The top wall has an opening communicating with the interior mating area. Latch members are mounted in the left and right side walls, respectively. The latch members are outwardly displaced to accommodate the downward movement of the mating end of the printed circuit member. The mating end of the printed circuit member is held in position, after the completion of the downward movement, by the force exerted on one surface of the circuit member from terminal conductor engaging ends contacting the exposed conductors and by the opposite force exerted on the opposite surface of the circuit member by resilient top ends of the latch members, thereby assuring the electrical connection.

4 Claims, 9 Drawing Sheets

ELECTRICAL CONNECTOR FOR CONNECTING FLEXIBLE PRINTED CIRCUIT BOARD

FIELD OF THE INVENTION

This invention relates to an electrical connector for connecting a flexible printed circuit board "FPC" or a flat flexible cable "FFC" to a printed circuit board.

BACKGROUND OF THE INVENTION

As is well know, a great number of such "FPC" and "FFC" or flexible printed circuit members are used in many applications, and the electrical connectors for connecting conductors on such boards or cables to other printed circuit boards are used accordingly.

The prior art connectors of this type are generally constructed in such a way that a connector housing has an opening or slot provided at the front end thereof and the printed circuit member is laterally inserted into such opening or slot of the housing so that each of the conductors on the printed circuit member will make contact with the contact portion of each terminal in the housing.

The prior art connectors described above, however, have a disadvantage in that in order to connect each of the conductors on the printed circuit member with the contact portion of each of the terminals in the housing, two separate operations must be done. The first operation is the lateral insertion of the mating end of the printed circuit member into the front opening or slot of the connector housing. The second operation is the-depression of the mating end of the printed circuit member after the insertion. Particularly for the insertion of the printed circuit member, it is difficult for a human operator to align the mating end portion of the printed circuit member board to the slot or opening for insertion because of the slot being positioned in front end of the housing.

With the recent tendency of realizing more and more compactness and low profile of the electrical connector, the size of the front slot for insertion of the printed circuit member has been significantly reduced. This makes it more and more difficult for the operator to properly align the mating end portion of the printed circuit member to the front slot of the connector housing.

SUMMARY OF THE INVENTION

In view of the above, an object of the present invention is to provide a new and improved electrical connector in which it comprises means for connecting and disconnecting the conductors on the printed circuit member to and from the terminal conductor engaging ends of said electrical connector with only one quick operation which can easily be done from the upper side of the electrical connector.

In order to achieve the above object, the present invention provides a board mounted electrical connector arrangement for connecting the exposed conductors at the mating end, having a given width, of a printed circuit member 28 to a printed circuit board. The connector arrangement includes a housing having a printed circuit member receiving slot leading into an interior mating area defined by inner surfaces of side walls, a plurality of terminals having a board engaging end and a conductor engaging end mounted in the housing, and means for holding the mating end of the circuit member in engagement with the connector. The improvement comprises a housing having a top wall with an opening joining the slot and contiguous with the mating area exposing the conductor engaging ends of the terminals. Holding means in the form of a pair of flexible latch members are mounted in the housing each member having a resilient top end adapted to engage the mating end as it is inserted downwardly into the interior mating area toward the terminals. The latch members are resiliently movable between a normal position, where the resilient top ends are spaced a distance less than the given width of the rigid mating end and a second position where the resilient top ends are spaced away from each other. Inserting the mating end into the mating area urges the top resilient ends away from each other and back to the normal position whereby the top ends are over the rigid plate so that the conductors are pressed into electrical engagement with the conductor engaging ends 14 of the terminals.

In another embodiment projections are provided on the inner surfaces of each of the side walls where the projections face toward each other and are adapted to contact edges of the mating end to prevent relative lateral movement between the mating end and the connector. In yet another embodiment a rigid plate is affixed to one surface on the mating end of the circuit member to define a rigid mating end. In still another embodiment the edges of the slot in the connector housing are adapted to cooperate with cut out portions in each edge of the mating end of the printed circuit member to prevent the removal of the mating end along the longitudinal axis of the printed circuit member.

BRIEF DESCRIPTION OF THE DRAWINGS

The invention, together with its objects and the advantages thereof, may be best understood by reference to the following description taken in conjunction with the accompanying drawings in which.

DETAILED DESCRIPTION OF THE PREFERRED EMBODIMENT

Figure 1:
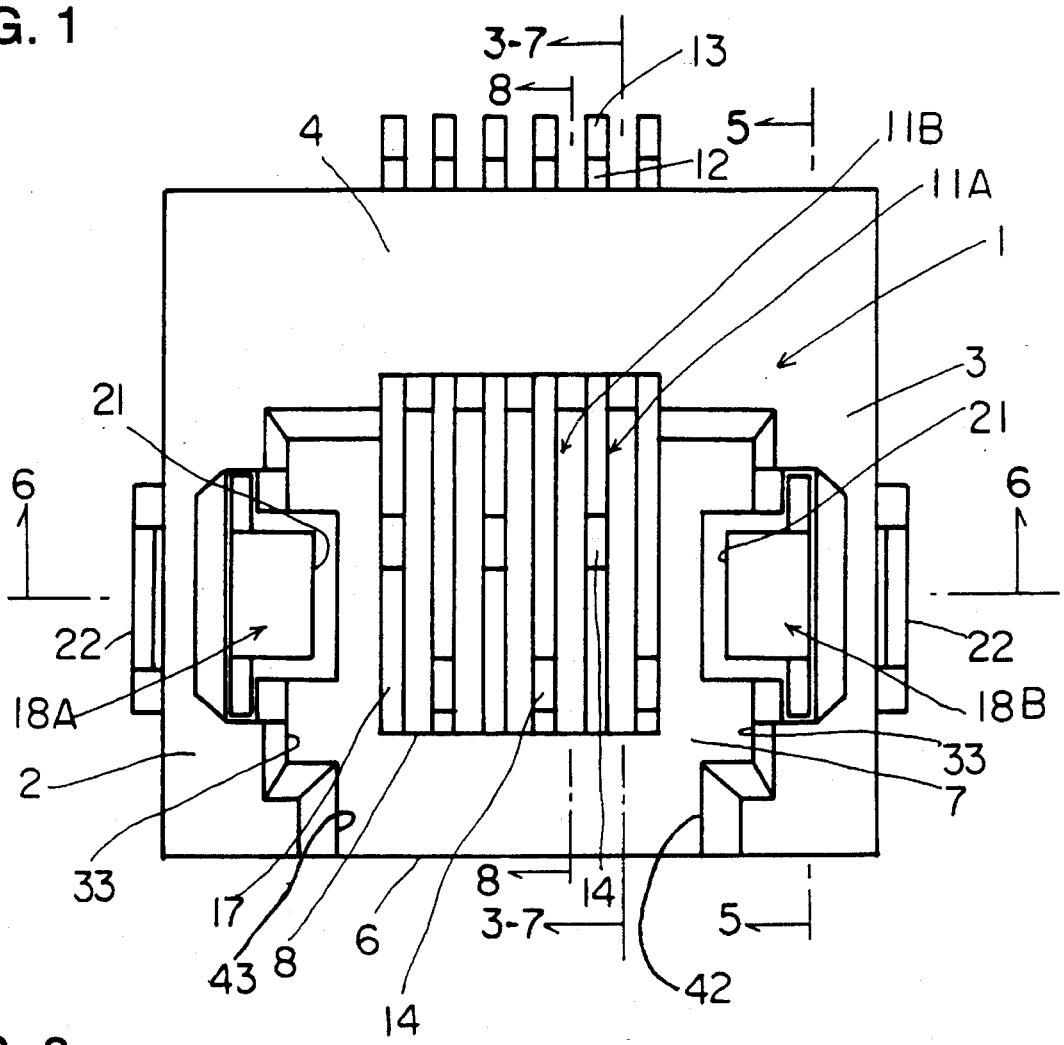
FIG. 1 is a plane view showing an electrical connector according to the present invention by one example.
Figure 2:
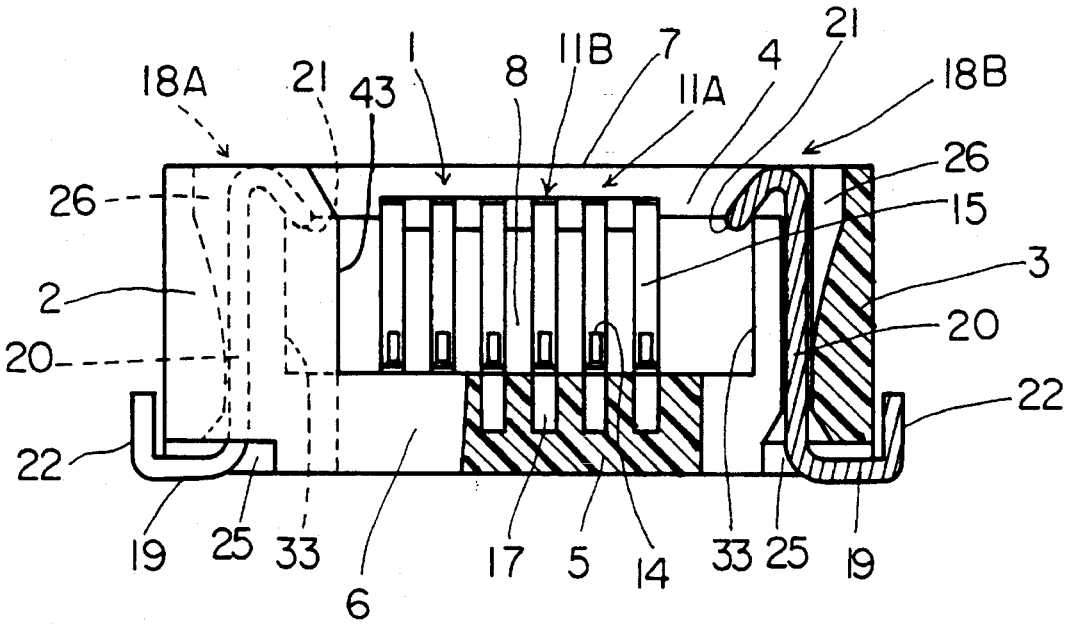
FIG. 2 is a front elevational view showing, fragmentally in cross section, the electrical connector shown in FIG. 1.

Referring to the drawings in greater detail and first to FIG. 1, an electrical connector comprises a connector housing 1 as shown in FIG. 1 which is defined by left and right side walls 2 and 3 as well as a top wall 4. These walls are integral with each other and with a bottom wall 5. In addition the connector housing 1 has a slot 6 in the front side thereof with edges 42,43 adapter to receive a printed circuit member and an opening 7 in the top wall 4 thereof. Accordingly an interior mating area 8 for a printed circuit member is formed which is defined by said bottom wall 5, said left and right side walls 2 and 3 as well as said top wall 4, and where the interior mating area communicates with the slot 6 and the top wall opening 7. The top wall 4 has a plurality of insertion openings 9 for mounting a plurality of terminals, and terminal press fit grooves 10 for holding the terminals mounted.

Figure 3:
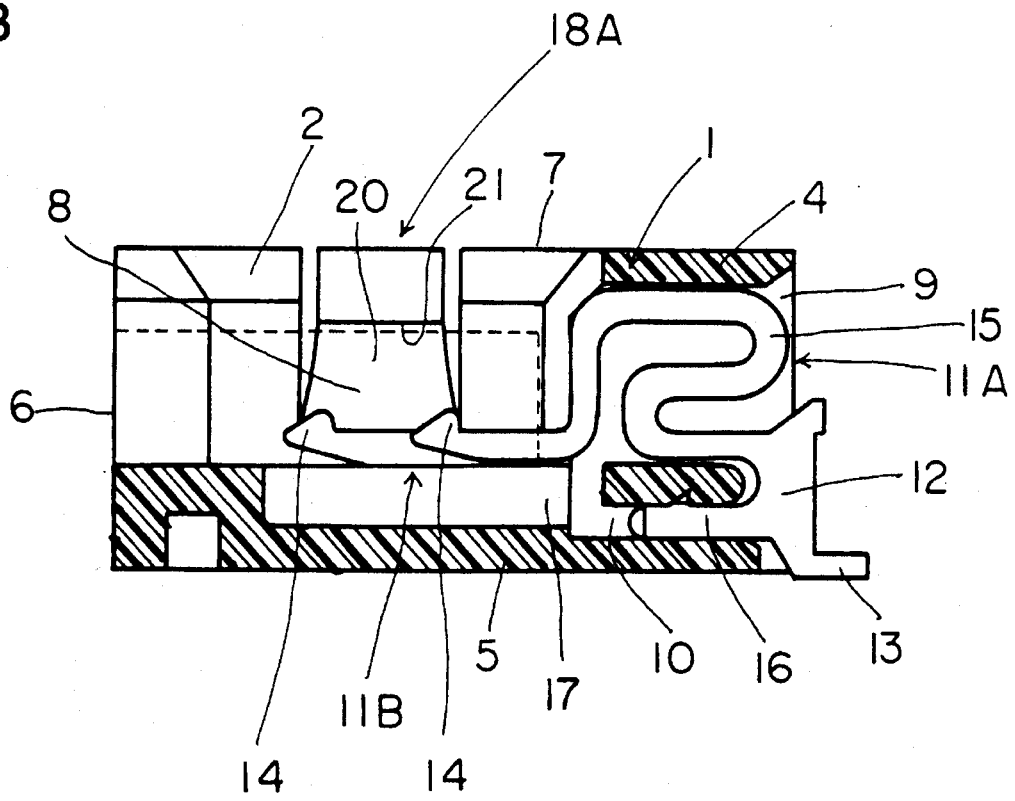
FIG. 3 is a cross sectional view of the electrical connector taken along the line 3—3 in FIG. 1.
Figure 4:
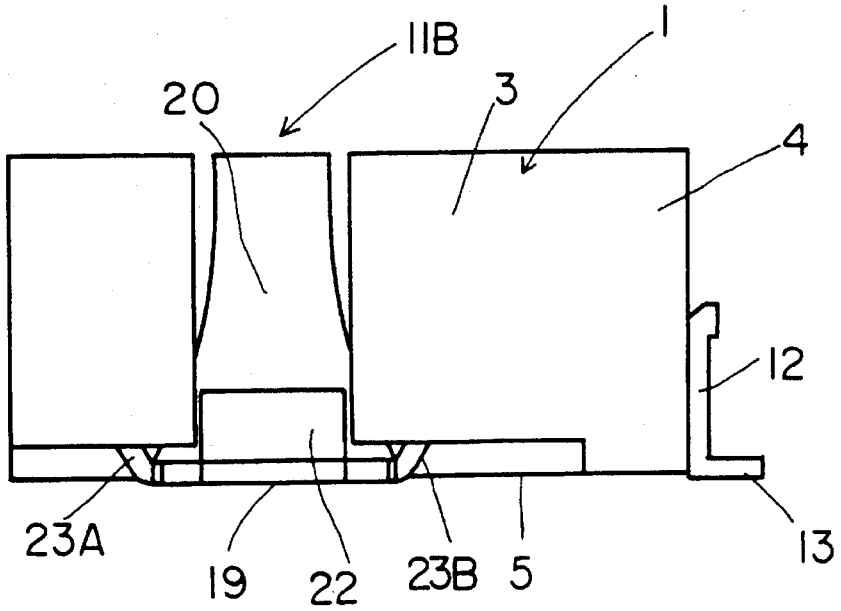
FIG. 4 is a side view of the electrical connector as viewed from the right-hand side thereof in FIG. 1.

Reference is now made to the terminals 11A, 11B which are mounted to said connector housing 1. It is to be noted here that the reference character "11A" indicates the terminals disposed at even-numbered positions from the right side wall 3, and "11B" indicates the terminals disposed at odd-numbered positions from the right side wall 3. Referring to FIG. 3 and more particularly to the terminals 11A at even-numbered positions, each of the terminals 11A include a base portion 12, a board engaging end 13 for surface mounting which is laterally extending from under the base portion 12, and a conductor engaging end 14. The base portion 12 and the conductor engaging end 14 are coupled together via a resilient portion 15 for upwardly displacing the conductor engaging end 14 when it is depressed downwardly as viewed in FIG. 3. In this example, the resilient portion 15 consists of "U" shaped pieces arranged in series. In addition, the terminal 11A has a press fit portion 16 positioned adjacent to said base portion 12 and extending in the direction opposite to that of the board engaging end 13.

It is to be noted that although the even-numbered terminals 11A and the odd-numbered terminals 11B are disposed in alternative positions, they are constructed in such manner that the conductor engaging end 14 of the odd-numbered terminals 11B forwardly extends a longer distance than that of the conductor engaging end 14 of the even-numbered terminals 11A.

In order to mount the terminals 11A, 11B in the connector housing 1, each of the terminals 11A, 11B is inserted into the rear opening 9 until the press fit piece 16 has completely entered into the press fit groove 10. At this time, the resilient portion 15 of each of the terminals 11A, 11B is positioned under the top wall 4 and the conductor engaging end 14 of each terminal faces toward the interior mating area 8. The bottom wall 5 is provided with recesses 17 which prevent the conductor engaging portions 14 of the terminals 11A, 11B from abutting the bottom wall 5 when the conductor engaging ends 14 are downwardly displaced as stated above. In this embodiment, a plurality of recesses 17 are provided each of which is positioned under each of the terminals 11A, 11B.

Figure 9:
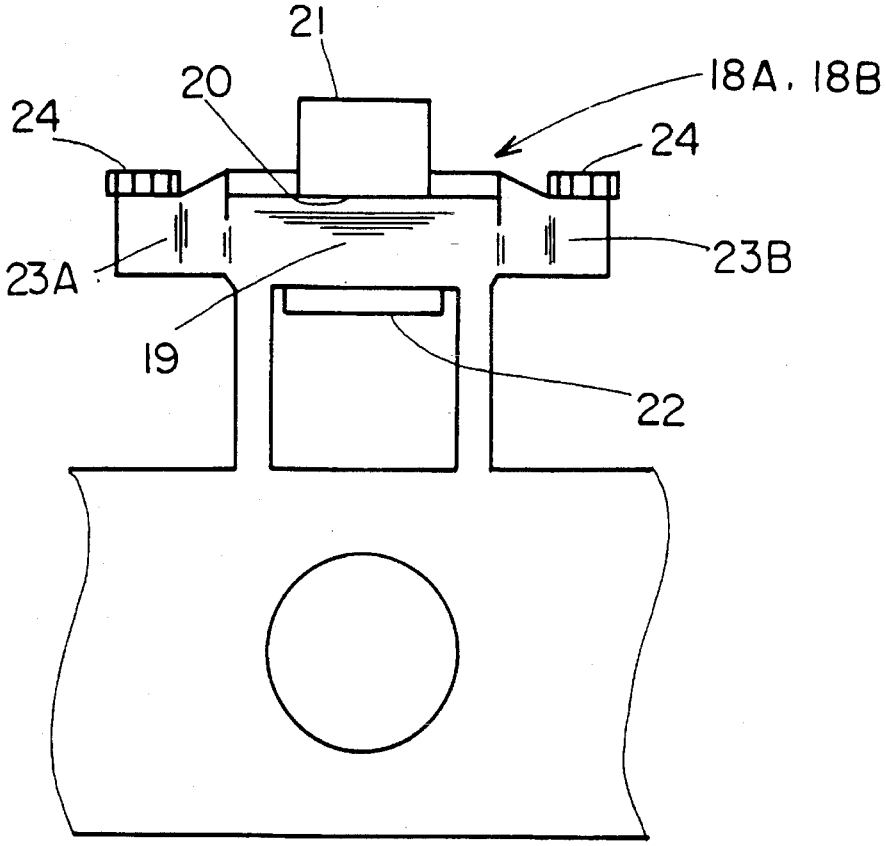
FIG. 9 is a plane view of the latch members coupled together with the carrier.
Figure 10:
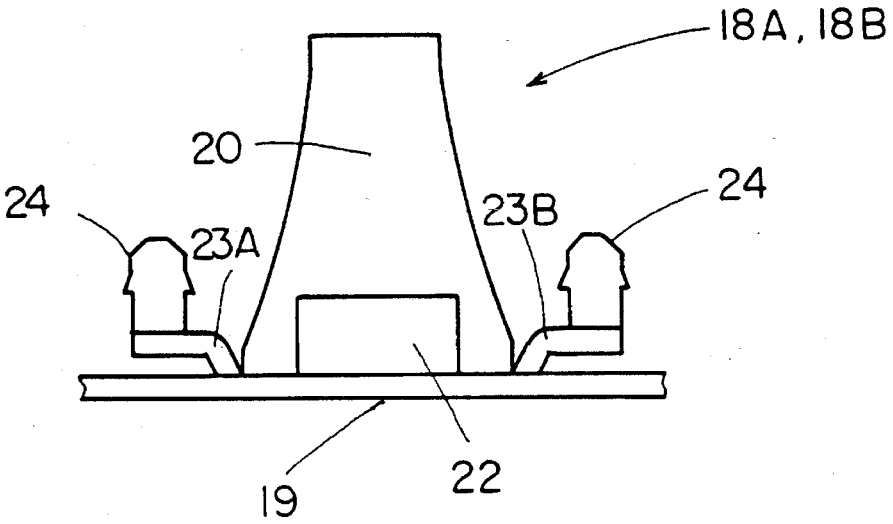
FIG. 10 is a front elevational view of the latch members shown in FIG. 9.
Figure 11:
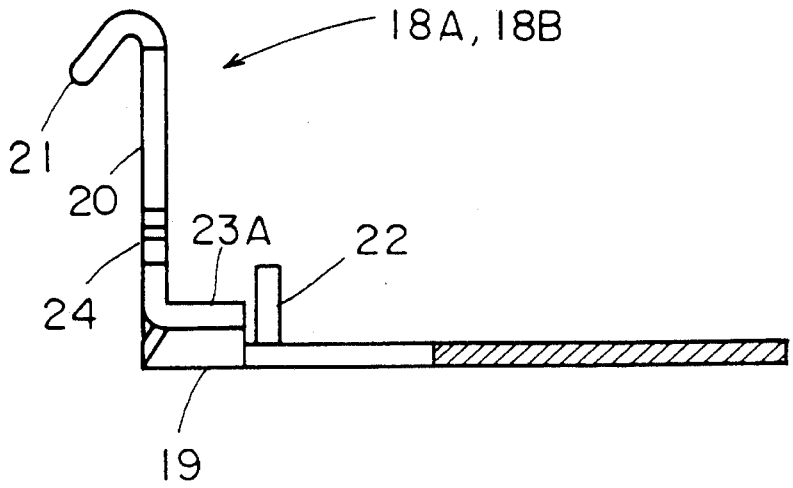
FIG. 11 is a side view of the latch members shown in FIG. 9.

Reference is now made to latch members 18A and 18B for holding the printed circuit member in place in cooperation with the contact pressure exerted by the conductor engaging ends 14 of the terminals 11A, 11B when the conductor engaging ends 14 are connected to the conductors on said printed circuit members. The latch members 18A, 18B are mounted to the left and right side walls 2 and 3, respectively. Referring to FIGS. 9, 10 and 11 which show the latch members 18A, 18B themselves, a horizontal bottom plate 19 is provided with a vertical portion 20 at one side thereof. The vertical portion 20 upwardly extends and downwardly bends to form a resilient top end 21.

The horizontal bottom plate 19 is also provided with a solder projection 22 upwardly extending from the opposite side thereof and two wing portions 23A, 23B extending from both ends of the bottom plate 19. The wing portions 23A, 23B are provided with latch projections 24 each vertically and upwardly extending. The resilient top end 21 and the vertical portion 20 can resiliently be deformed in order that the resilient top end 21 can contact an edge of and hold the mating end of the printed circuit member.

Figure 5:
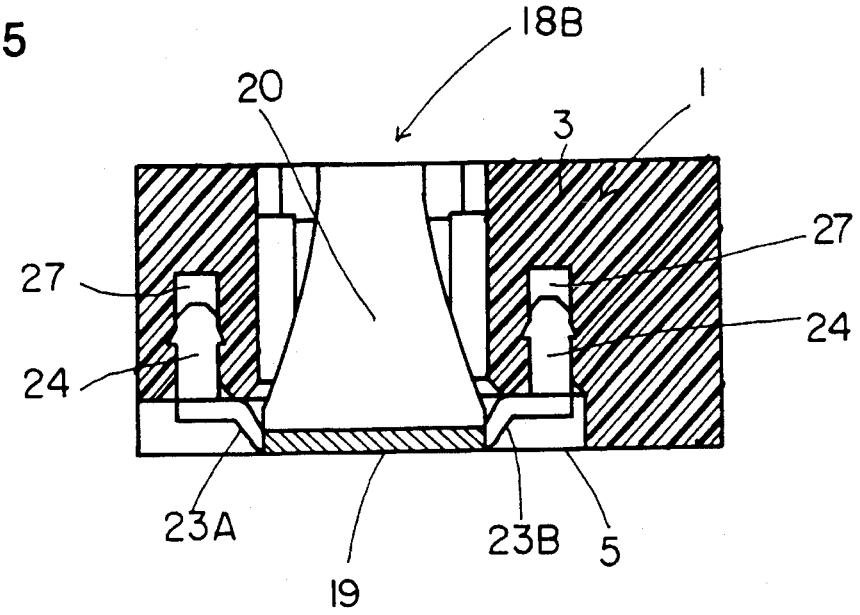
FIG. 5 is a cross sectional view of the electrical connector taken along the line 5—5 in FIG. 1.

In order to mount the latch members 18A, 18B in the connector housing 1, the left and right side walls 2 and 3 of the housing 1 are provided with mounting grooves 25 at each of the bottom portions thereof and inner grooves 26 at each of the inner surfaces thereof. The latch members 18A, 18B are mounted in the housing 1 with the top ends 21 on the free ends of the latch members facing towards the inside of the housing, the vertical portions 20 extending along the inner surfaces of the left and right walls 2 and 3, the bottom portions 19 received within the mounting grooves 25, and the solder projections 22 positioned outside of the left and right walls 2 and 3. In addition, as shown in FIG. 5, the latch projections 24 on the wings 23A, 23B each extending in both directions from the latch members 18A, 18B are entered and secured within latch grooves 27 provided in the side walls 2 and 3, thereby fixing the latch members 18A, 18B within the housing 1.

Figure 12:
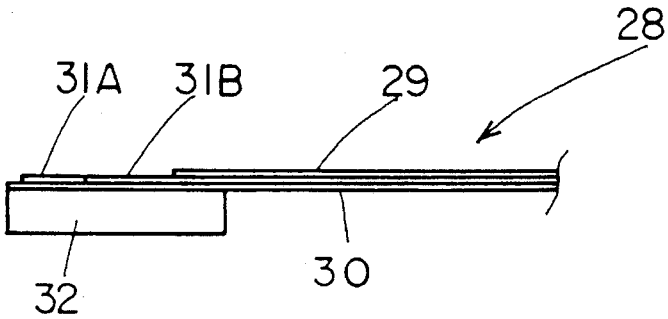
FIG. 12 is a side view of the printed circuit member.
Figure 13:
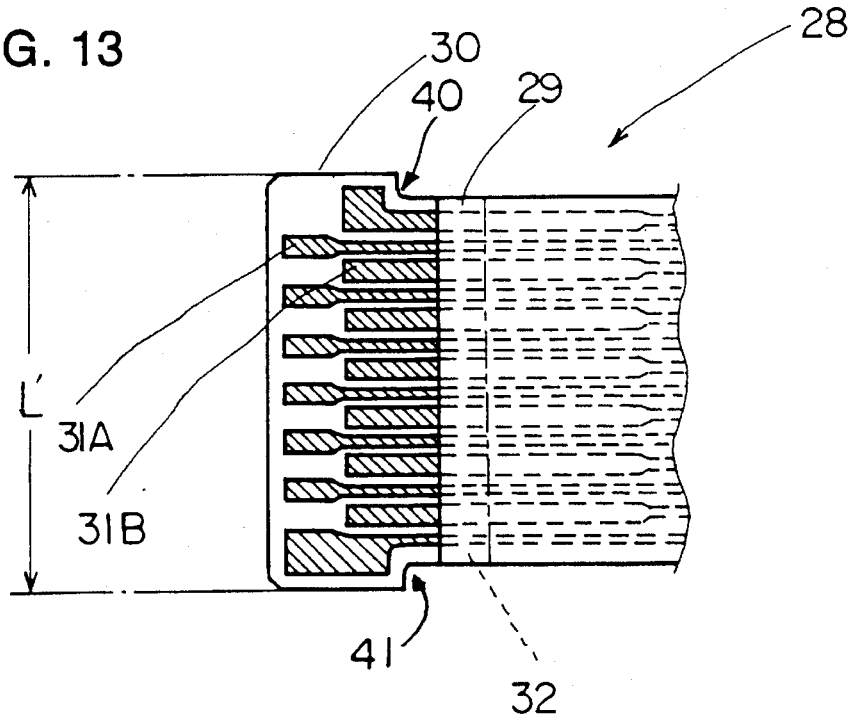
FIG. 13 is a plane view of the flexible printed circuit member.

Referring now to FIGS. 12 and 13, the printed circuit member 28 to be connected to the terminals 11A, 11B of the electrical connector will be described. As is well known, the printed circuit member 28 consists of the conductors 31A, 31B sandwiched between the flexible sheets of insulation 29 and 30. As shown in FIG. 13, the ends of the conductors 31A, 31B are arranged in alternative or staggered array and are exposed by removing the insulation 29. In this example, the even-numbered terminals 11A of the electrical connector are to be connected to the even-numbered conductors 31A and the odd-numbered terminals 11B is to be connected to the odd-numbered conductors 31. Furthermore, in the preferred embodiment, insulation sheet 30 has a rigid metal reinforcement plate 32 affixed at the mating end portion thereof. However, this invention will work effectively without such a reinforcement plate if the mating end of the printed circuit member has adequate rigidity for the movement of the latch members 18A, 18B as described below. The metal reinforcement plate 32 has a width equal to that of the insulation 30 of the mating end of the printed circuit member.

The interior mating area 8 for the printed circuit member is defined between the left and right walls 2 and 3 of the housing 1, and more precisely, between its inner surfaces 33 and 33. The width "l" between the inner surfaces 33 and 33 is only slightly greater than the width "L" of said the mating end and the rigid reinforcement plate 32 for the circuit board, Therefore, the printed circuit member 28 and the reinforcement plate 32 are positioned in the space between the inner surfaces 33 and 33 with less gap therebetween. The resilient top ends 21 on the free ends of the left and right latch members 18A and 18B extend ;beyond the inner surfaces 33 of the side walls 2 and 3. Cut out portions 40,41 are provided in the mating end of the printed circuit member and the reinforcement plate to cooperate with edges 42,43 of slot 6.

Figure 6:
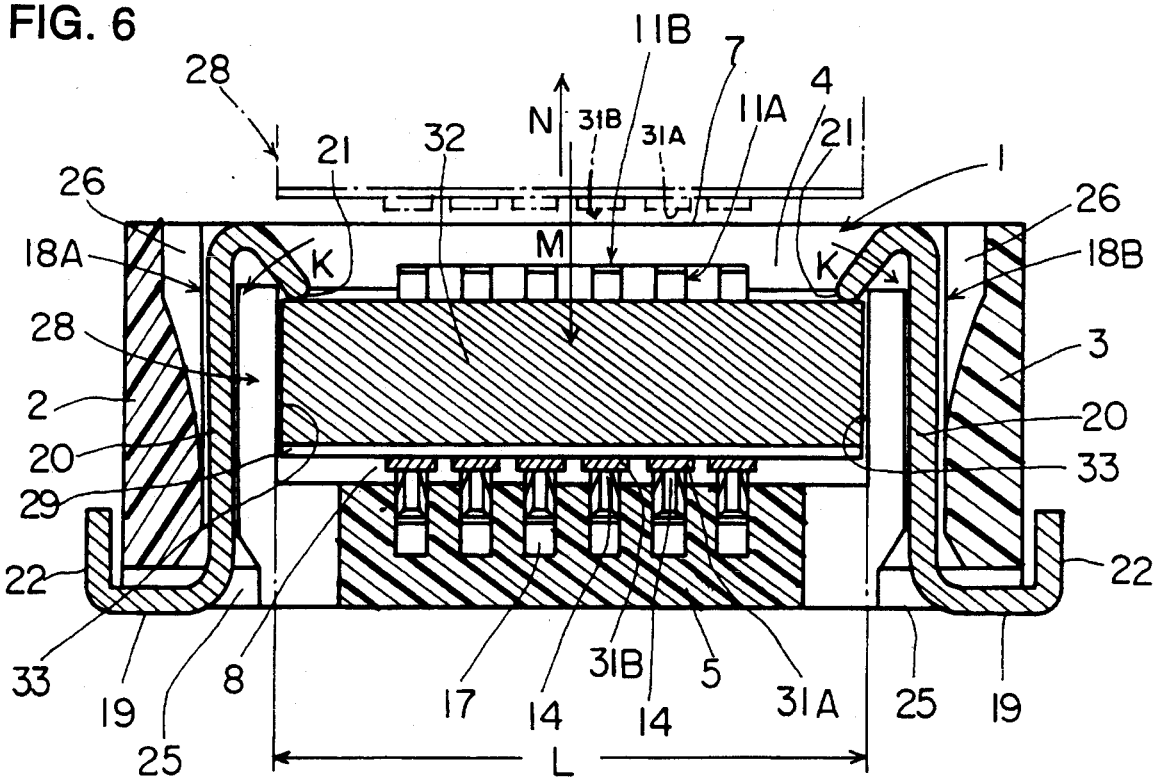
FIG. 6 is a cross sectional view taken along line 6—6 in FIG. 1 showing the electrical connector after the printed circuit member is connected thereof.
Figure 7:
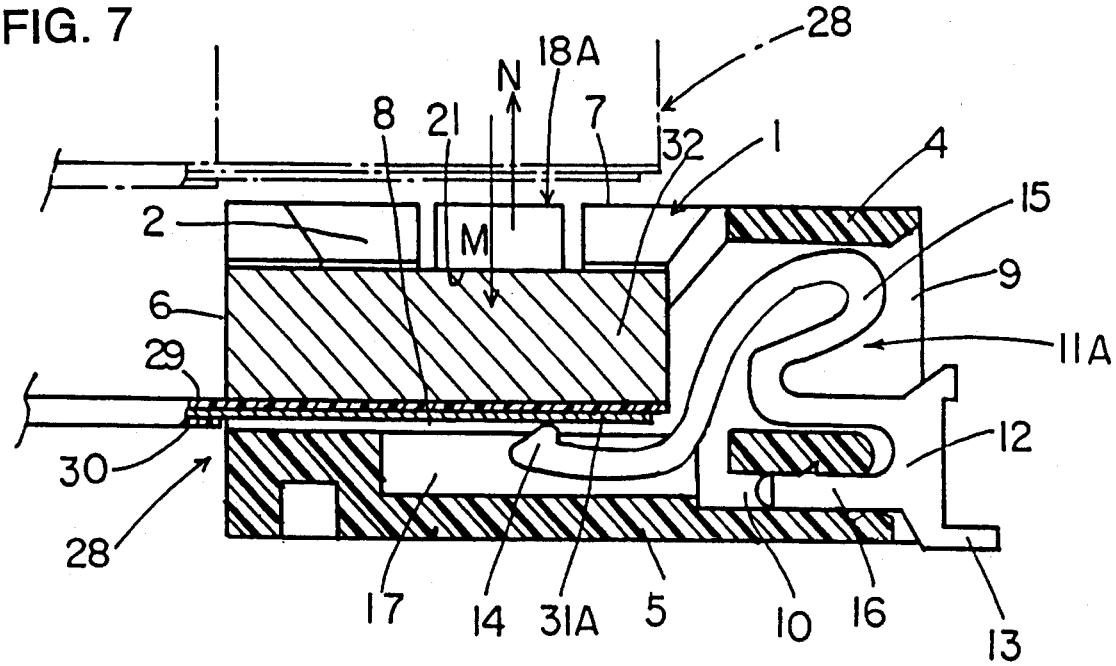
FIG. 7 is a cross sectional view taken along line 7—7 in FIG. 1, showing the electrical connector after the printed circuit member is connected thereto.
Figure 8:
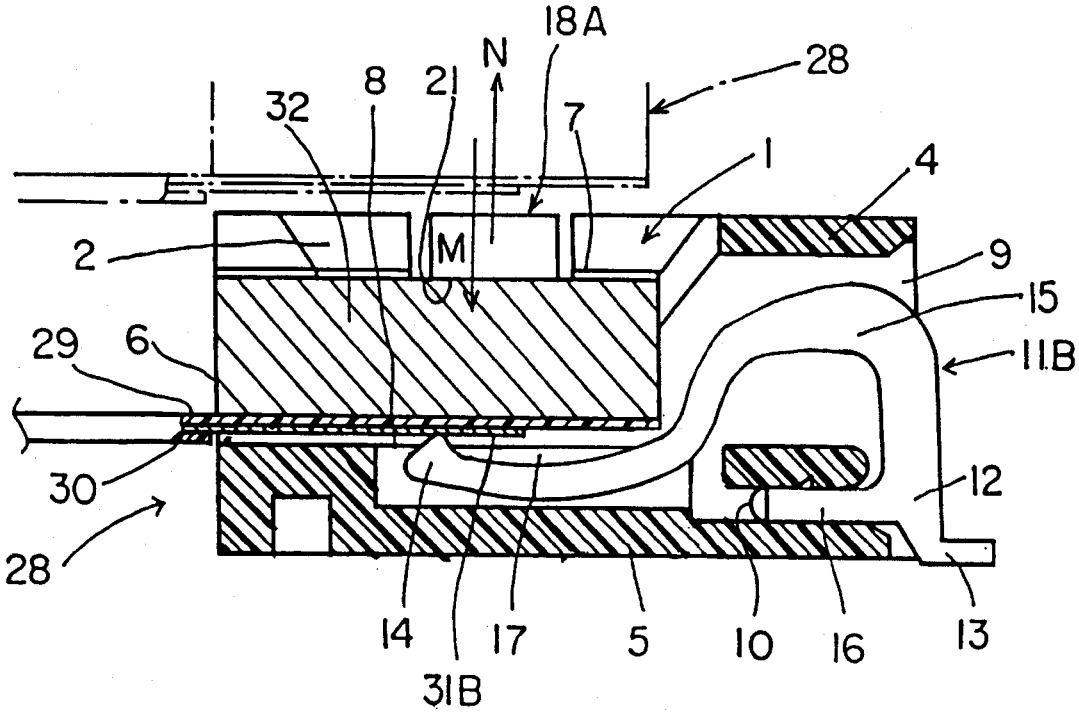
FIG. 8 is a cross sectional view taken along line 8—8 in FIG. 1, showing the electrical connector after the printed circuit member is connected thereto.

Referring now to FIGS 6,7 and 8, the operation of the electrical connector shown in FIG. 1 through 13 will be described below. In order to connect the conductors 31A, 31B on the printed circuit member 28 with the terminals 11A, 11B of the electrical connector, the printed circuit member 28 is positioned in a plane substantially parallel to and above the interior mating area 8 where the cut out portions 40,41 are aligned with the edges 42,43 of slot 6. There is no need for the printed circuit member to be inserted into the front receiving slot 6 as in the prior art. The flexible printed circuit member 28 in this position above the connector housing is indicated by a phantom. Line in FIG. 6, 7 and 8. Once in this position the printed circuit member 28, with the reinforcement plate 32 facing upward, is directed downwardly as indicated by arrow M while keeping it substantially horizontal. In the course of this downward movement both side portions of the insulation 29 contact and begin moving the resilient top ends 21 of the latch members 18A, 18*b* from their normal at rest position. Further downward movement of the printed circuit member 28 causes the deformation of the resilient top ends 21 and the vertical portions 20 of the latch members 18A, 18B towards the inner grooves 26 of the side walls 2 and 3 as indicated by an arrow K. In this second position the latch members 18A, 18B can accommodate the insertion of the printed circuit member 28 with the rigid plate. Further insertion of the member 28 forces conductors 31A, 31B into contact with the conductor engaging ends 14 of the terminals 11A, 11B causing conductor engaging ends 14 to be downwardly displaced. This downward displacement of the conductor engaging ends 14 are made possible by its resilient portions 15. After the reinforcement plate 32 of the printed circuit member 28 is moved past the resilient top ends 21, these resilient top ends 21 and the latch members 18A, 18B are restored to the normal at rest position by the resiliency of the vertical portions 20 as shown in FIG. 6. The inserted portion of the printed circuit member is held in the horizontal plane in the connector between the upward force exerted by the conductor engaging ends 14 of the terminals 11A, 11B, and the downward force exerted by the resilient top ends 21. This assures the connection between the conductors 31A, 31B on the printed circuit member 28 and the terminals 11A, 11B. Also the cooperation between the edges 42,43 of slot 6 and cut out portions 40,41 of the mating end assures that the mating end is not polled out of the terminal in a direction along the longitudinal axis of the printed circuit member.

In order to disconnect the printed circuit member from the electrical connector, the resilient top ends 21 of the latch members 18A. 18B may simply be outwardly displaced with the fingers or any jigs as indicated by the arrow K. Then the reinforcement plate 32 is released by the resilient top ends 21 so that the printed circuit member 28 can be moved upwardly as indicated by arrow N under the influence of the upward force exerted by the conductor engaging ends 14 of the terminals 11A, 11B so that cut out portions 40, 41 clear the slot edges 42, 43. Then the operator can take up the preinted circuit member 28 for disconnection.

According to the present invention, the connection of the printed circuit member to the electrical connector can be achieved with only the one operation of downwardly depressing the printed circuit member into the interior mating area of the housing from the upper side. There is no need to align the end portion of the printed circuit member with the front slot which is small because of the need for compactness and low profile.

Figure 14:
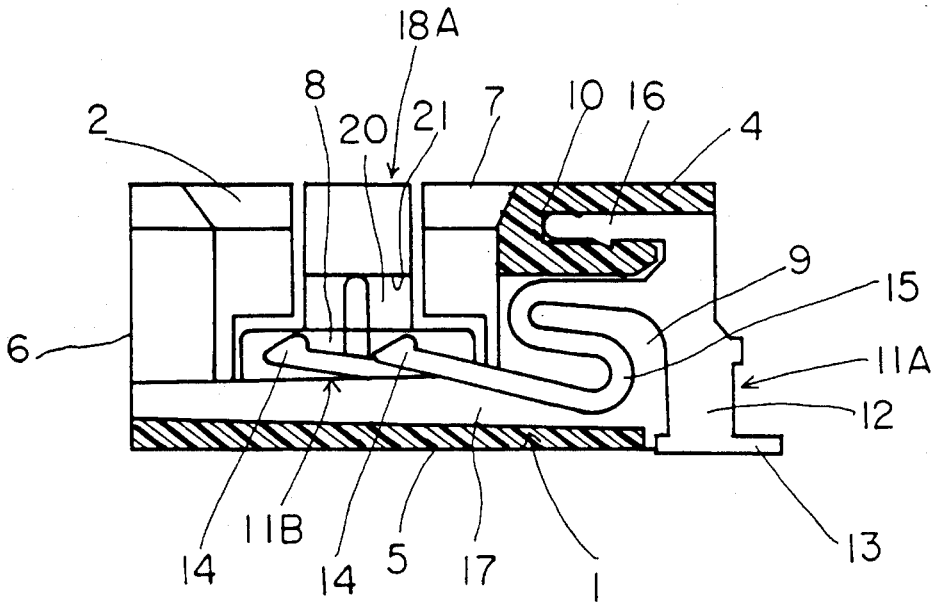
FIG. 14 is a cross sectional view of the electrical connector showing another example of the terminals.
Figure 15:
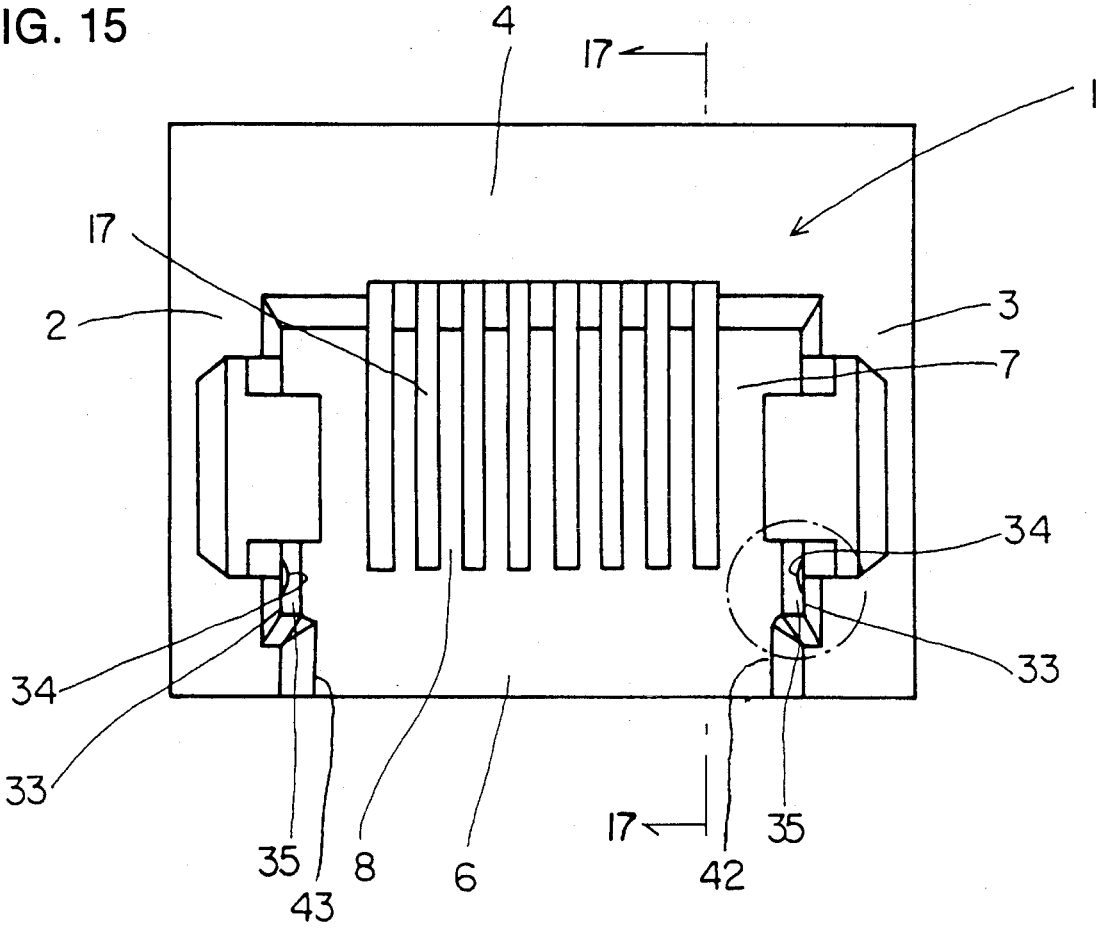
FIG. 15 is a plane view of an electrical connector in which a connector housing is provided with projections, constructed according to further embodiment of the present invention, with the terminals and the latch members omitted for the sake of clarity.

Referring now to FIG. 14 which represents the second embodiment of the present invention, the press fit piece 16 of each of the terminals 11A, 11B is formed in the upper portion separated from the printed circuit member engaging and 13 and is pressed into the press fit groove 10 in the upper portion of the housing 1. In addition various shapes of the resilient portion 15 may be used. The electrical connector according to this embodiment can be operated in the same manner as that of the first embodiment as described before.

Figure 16:
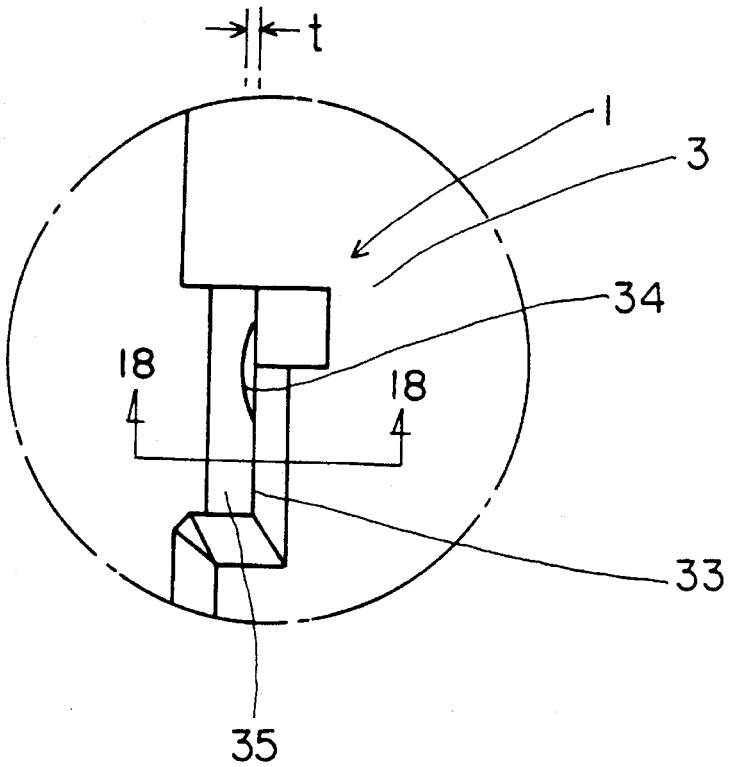
FIG. 16 is an enlarged view showing the portion indicated by a circle of point-dot line in FIG. 15.
Figure 17:
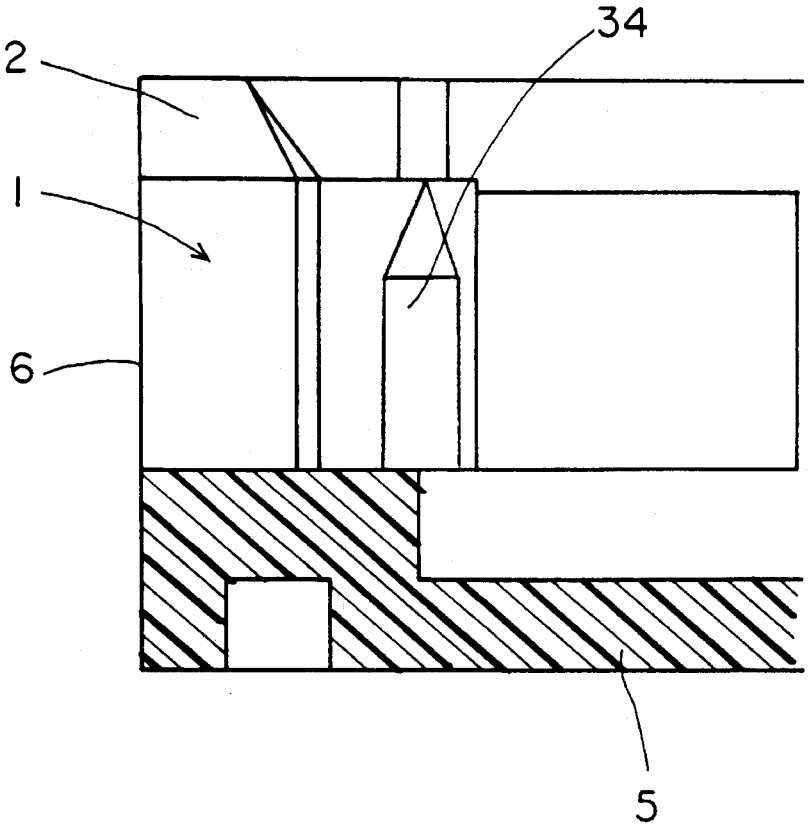
FIG. 17 is a fragmental cross sectional view taken along the line 17—17 in FIG. 15.
Figure 18:
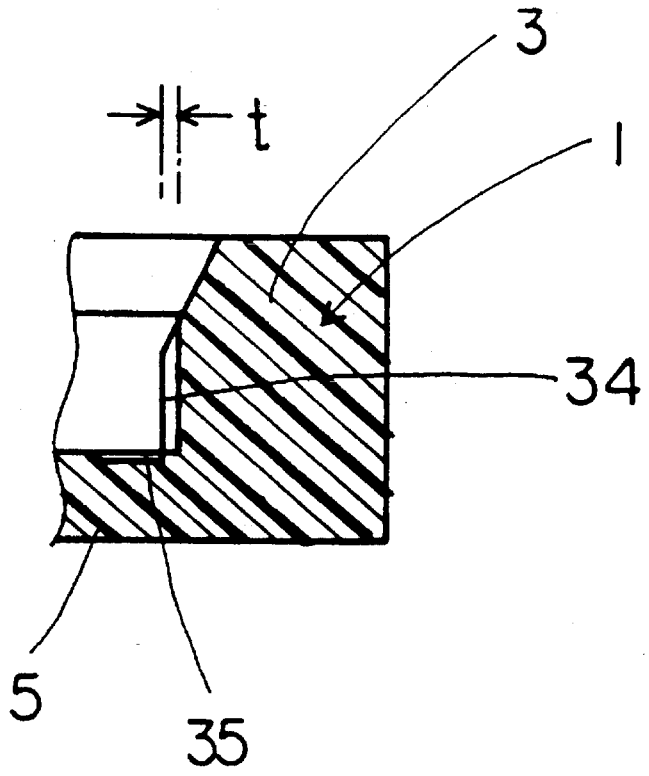
FIG. 18 is a fragmental cross sectional view taken along the line 18—18 in FIG. 16.

FIGS. 15, 16, 17 and 18 show the third embodiment of the present invention. In these figures the terminals and the latch members are omitted for the sake of clarity. The third embodiment can be operated in the same manner as that of the first embodiment. In this embodiment, projections 34 are formed on each of the inner surfaces 33 of the left and right side walls 2 and 3 at the position near the front slot 6. The projections 34 only slightly extend a distance t into the interior mating area 8 towards the printed circuit member. In addition, bottom grooves 35 are formed in the bottom wall 5. The projection 34 has a gradual spherical surface as shown in FIG. 16 and a gradual radius upper surface as shown in FIG. 18. The lower portion of the projection 34 communicates with the bottom wall 5 and the bottom groove 35 is formed near the bottom end of the projection 34.

The purpose of the projections 34 is to prevent lateral movement between the printed circuit member 28 and the electrical connector, which is called "clattering". The pitch of the conductors on the printed circuit member 28 should correspond to that of the conductor engaging ends 14 of the terminals 11A, 11B. In addition to the requirement of the correct pitches of both of the conductors on the printed circuit member 28 and the terminals, the printed circuit member 28 should be smoothly settled in the space between the inner surfaces 33 and 33 of the left and right walls 2, 3 of the housing 1 without any clattering. In other words, the width L between the inner surfaces 33 and 33 relative to the width L' of the mating end of the printed circuit member should be such that there is no occurrence of such clattering in left and right directions. Unfortunately there is a possibility of some production error. For example, if the size L between the inner surfaces 33 and 33 become slightly greater than the width L' of the mating end, there may exist a higher possibility of such clattering of the printed circuit member 28. According to the present invention, however, the left and right projections 34 described above serve to correctly position the mating end of the printed circuit member 28 depressed therebetween, thereby avoiding the possibility of clattering in the left and right directions.

More precisely when the printed circuit member 28 is depressed from the upper side of the housing 1, due to the fact that the width L' of the printed circuit member 28 is smaller than the width L between the inner surfaces 33 and 33 in this example, then the printed circuit member 28 does not abut the inner surfaces 33, but abuts the projections 34.

Because of their small size, projections 34 can be scraped away by the edges of the reinforcement plates 32 of the printed circuit member 28 so that the mating end can correctly be positioned in such condition between left and right projections 34. As the case may be, the left and right walls 2 and 3 may outwardly be displaced due to the spherical surfaces of the projections 34 so that the printed circuit member 28 may correctly be positioned therebetween.

On the other hand, if the production is made in such way that the width L between the inner surfaces 33 and 33 of the side walls 2 and 3 correspond to the width L' of the printed circuit member 28 so that there is no possibility of clattering, then the depression of the printed circuit member 28 to the space between the inner surfaces 33 and 33 similarly causes the projections 34 to be scraped away by the edges of the rigid reinforcement plate 32 or the outward displacement of the side walls 2 and 3 due to the projections 34. In either case, the printed circuit member 28 can correctly be positioned between the left and right projections 34 of the side walls 2 and 3.

As described above, the conductors 31A, 31B on the printed circuit member 28 can correctly be connected to the conductor engaging ends 14 of the terminals 11A, 11B without any pitch shift in left and right directions.

The bottom groove 35 serves to collect the residual material if produced when the projections 34 are scraped away. However, because the projections 34 are small to accommodate minor production errors, there may be a small amount if any of the residual material. Therefore the bottom groove 35 may be omitted.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A member mounted electrical connector arrangement for connecting exposed conductors in one surface at the mating end of a printed circuit member to a printed circuit board, said connector arrangement said mating end having a given width including, a housing having a printed circuit member receiving slot in a front wall of the housing leading into an interior mating area defined, in part, by inner surfaces of side walls and, a plurality of terminals mounted in the housing having a board engaging end and a conductor engaging end, and means for holding said mating end of the printed circuit member in engagement with the connector, the improvement comprising:

said housing having a top wall with an opening joining the slot and contiguous with the interior mating area exposing the conductor engaging ends of the terminals; and holding means including a pair of latch members mounted in the housing and having a resilient top end adapted to engage a surface of the mating end having an insulation layer thereon when the mating end is inserted downwardly through opening into the interior mating area toward the terminals, said latch members being resiliently movable between a normal position, where the resilient top ends are spaced a distance less than the given width of the mating end and a second position, where the resilient top ends are spaced away from each other wherein the mating end urges the resilient top ends away from each other as the mating end is inserted downwardly into the interior mating area and back to the normal position whereby the top ends are located over the mating end so that the exposed conductors are held in electrical engagement with the conductor engaging ends of the terminals.

2. An electrical connector arrangement according to claims 1 further comprising projections provided on the inner surfaces of each of the side walls and, said projections projecting towards each other and adapted to contact edges of the mating end whereby relative lateral movement between the mating end and the connector, when the mating end is in the interior mating area, is prevented.

3. An electrical connector arrangement according to claim 1 further comprising a rigid plate affixed to the surface of the mating end opposite to the surface having the exposed conductors the rigid plate having the same width as the width of the mating end and adapted to engage and be held by the top ends of the flexible latch members.

4. An electrical connector arrangement according to claim 1 where edges of the circuit member receiving slot are adapted to receive said mating end having portions cut out of each edge cooperating with the slot so that the circuit member is held in the interior mating area of the housing whereby removal of the mating end along the longitudinal axis of the circuit member is prevented.

* * * * *